US005344045A

United States Patent [19]

Richter et al.

[11] Patent Number: 5,344,045

[45] Date of Patent: Sep. 6, 1994

[54] LIQUID CONTAINER SYSTEM

[75] Inventors: Simon J. Richter, Marietta; Gary V. Paisley, Lilburn, both of Ga.

[73] Assignee: The Coca-Cola Company, Atlanta, Ga.

[21] Appl. No.: 66,834

[22] Filed: May 24, 1993

Related U.S. Application Data

[63] Continuation-in-part of Ser. No. 803,241, Dec. 5, 1991, Pat. No. 5,242,085, which is a continuation-in-part of Ser. No. 628,819, Dec. 17, 1990, abandoned.

[51] Int. Cl.[5] ..... B65D 35/28; B65D 83/00; B67D 1/00

[52] U.S. Cl. ..... 222/1; 222/386.5; 220/461; 215/1 C; 428/35.2

[58] Field of Search ..... 220/461, 462; 222/94, 222/95, 105, 107, 183, 1, 386.5; 383/80; 53/175; 428/35.2, 34.7, 12; 215/1 C, 12.2

[56] References Cited

U.S. PATENT DOCUMENTS

| | | | |
|---|---|---|---|
| 2,715,980 | 8/1955 | Frick | 222/183 |
| 2,732,977 | 1/1956 | Charpiat . | |
| 3,040,933 | 6/1962 | Everett | 222/95 |
| 3,118,572 | 1/1964 | Harding . | |
| 3,161,327 | 12/1964 | Kraus . | |
| 3,178,062 | 4/1965 | Welty et al. . | |
| 3,239,102 | 3/1966 | Heydan et al. . | |
| 3,409,714 | 11/1968 | Strugar, Jr. | 222/105 X |
| 3,592,360 | 7/1971 | Aleck | 222/95 |
| 3,727,783 | 4/1973 | Carmichael . | |
| 3,765,574 | 10/1973 | Urquiza | 222/183 |
| 3,876,119 | 4/1975 | Lamkin | 222/386.5 X |
| 3,940,001 | 2/1976 | Haefner et al. . | |
| 3,945,539 | 3/1976 | Sossong . | |
| 4,008,830 | 2/1977 | Meshberg . | |
| 4,008,831 | 2/1977 | Vidilles | 222/105 X |
| 4,286,636 | 9/1981 | Credle, Jr. . | |
| 4,350,272 | 9/1982 | Petterson | 222/386.5 |
| 4,463,875 | 8/1984 | Tepic | 222/94 X |
| 4,482,588 | 11/1984 | Fagerburg et al. . | |
| 4,484,697 | 11/1984 | Fry, Jr. . | |
| 4,501,781 | 2/1985 | Kushida et al. . | |
| 4,550,043 | 10/1985 | Beck . | |
| 4,609,516 | 9/1986 | Krishnakumar et al. . | |
| 4,646,925 | 3/1987 | Nohara . | |
| 4,696,840 | 9/1987 | McCullough et al. | 222/105 X |
| 4,723,688 | 2/1988 | Munoz . | |
| 4,796,788 | 1/1989 | Bond . | |
| 4,881,666 | 11/1989 | Tullman et al. . | |
| 4,892,230 | 1/1990 | Lynn, Jr. . | |
| 4,921,135 | 5/1990 | Pleet . | |
| 4,966,543 | 10/1990 | Krishnakumar et al. . | |
| 4,972,969 | 11/1990 | Randklev | 222/94 X |
| 4,979,631 | 12/1990 | Krishnakumar et al. | 215/1 C X |
| 4,980,100 | 12/1990 | Krishnakumar et al. . | |
| 5,037,002 | 8/1991 | Tschanen | 222/105 |

FOREIGN PATENT DOCUMENTS

| | | |
|---|---|---|
| 570451 | 9/1958 | Belgium . |
| 0182094 | 5/1986 | European Pat. Off. . |
| 3618634 | 12/1987 | Fed. Rep. of Germany . |
| 2164825 | 8/1973 | France . |
| 00094 | 8/1992 | PCT Int'l Appl. . |
| 1032825 | 6/1966 | United Kingdom . |
| 1171612 | 11/1969 | United Kingdom . |
| 1455453 | 11/1976 | United Kingdom . |

*Primary Examiner*—Andres Kashnikow
*Assistant Examiner*—Kenneth DeRosa
*Attorney, Agent, or Firm*—Thomas R. Boston; W. Dexter Brooks

[57] ABSTRACT

A liquid container comprising a multi-layer container including a wall made up of a main layer and a separate, delaminatable inner layer, a container opening at the top for filling and evacuation and a plurality of air vents extending completely through the main layer and terminating at the inner layer, such that the inner layer delaminates when liquid is evacuated by suction. The inner layer is thicker at the top end of the container and the air vents have a larger size opening at the bottom of the container, both to prevent premature collapse of the top end of the inner layer. The inner layer is also at least partially predelaminated during (or right after) manufacturing to assist ease of delamination during use.

7 Claims, 5 Drawing Sheets

LIQUID CONTAINER SYSTEM

CROSS-REFERENCE TO RELATED APPLICATION

This application is a continuation-in-part to U.S. patent application Ser. No. 07/803,241, filed Dec. 5, 1991, now U.S. Pat. No. 5,242,085, and having the same title, inventors and assignee, which was in turn a continuation-in-part to U.S. patent application Ser. No. 07/628,819, filed Dec. 17, 1990, now abandoned, and having the same title, inventors and assignee.

BACKGROUND OF THE INVENTION

The present invention relates to a blow molded plastic container of laminated construction for syrup or flavor concentrate suitable for use with a post-mix beverage dispenser. More specifically, the present invention relates to a disposable and recyclable container for supplying syrup or flavor concentrate, said container being connectable to a syrup pump which withdraws the syrup or flavor concentrate from the container by suction and feeds it to a post-mix dispenser.

In post-mix beverage dispensers, such as those used in fast-food restaurants or the like, the syrup is presently supplied from either a reusable stainless steel, pressurized container with a five-gallon capacity, or a disposable bag-in-box type of container. The stainless steel type of container is known as a "figal", an accepted abbreviation in the beverage dispensing art for a syrup container with a five-gallon capacity fabricated primarily of stainless steel. "Figal" containers are generally described in U.S. Pat. No. 3,186,577 to Tennison. Because the figal container must be strong enough to withstand the $CO_2$ pressure used to pressurize the Figal to force the syrup to the dispenser, it is relatively expensive to manufacture, and it must be kept after use and then returned to the syrup supplier, where it is sanitized and reused.

In contrast, bag-in-box packages for syrup are disposable, more convenient and less expensive. However, known bag-in-box type packages are not easily recyclable because of the many different materials used therein including the outer shrink wrap, the paperboard box, the two layer bag, the spout, the dipstrip, and the valve. Thus, an associated waste disposal problem results. A typical bag-in-box type package is disclosed in U.S. Pat. No. 4,286,636 to Credle.

Bag-in-box packages of the general type disclosed in the Credle '636 Patent are in wide use today in beverage dispensing systems which include gas-operated reciprocating pumps in the syrup line between the bag-in-box package and the dispenser. The syrup line is connected to the bag by a quick-disconnect coupling. An example of such a quick-disconnect coupling is also illustrated in the Credle '636 Patent.

Accordingly, a need exists in the art for a disposable, inexpensive syrup container for use with post-mix beverage dispensers, which is also recyclable.

SUMMARY OF THE INVENTION

The liquid container system of the present invention comprises filling a PET container with syrup and connecting the syrup container to a post-mix beverage dispenser through a bag-in-box syrup pump. The syrup container includes a wall, a container opening, an air vent or a plurality of air vents, and a PET closure connected to the container opening. The wall preferably includes an outer and an inner PET layer and a release agent therebetween, such as a layer of EVOH. As syrup is withdrawn from the container, the inner PET layer separates from the outer PET layer and collapses around the remaining syrup, eliminating the need for venting the syrup chamber to atmosphere. When all of the syrup has been evacuated, a vacuum is drawn so that existing bag-in-box sold-out devices can be used. After use, the PET container is disposable and can be recycled. During manufacture, the inner layer is preferably at least partially predelaminated by gas pressure through the lower air vent (after the predelamination, the inner layer is returned by gas pressure to its original shape) to make it easier for the inner layer to begin to collapse or delaminate in actual use. In addition, to prevent premature collapse of the inner layer at the top of the container, the inner layer preferably has a greater thickness (stiffness) adjacent the top of the container than does the portion of the inner layer adjacent the bottom of the container, and also the air vents are larger in diameter adjacent the bottom of the container to restrict the air flow to the top of the inner layer.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENTS

With reference now to the drawings, FIGS. 1–12 show the liquid container system of the present invention.

Figure 5:
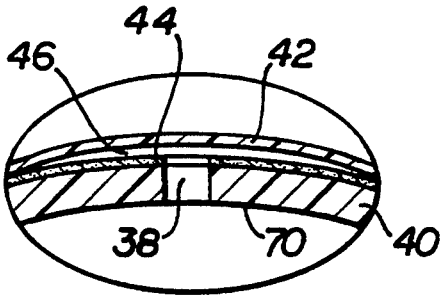
FIG. 5 is a view identical to FIG. 2 but showing the separation occurring at the beginning of product evacuation from the container.
Figure 6:
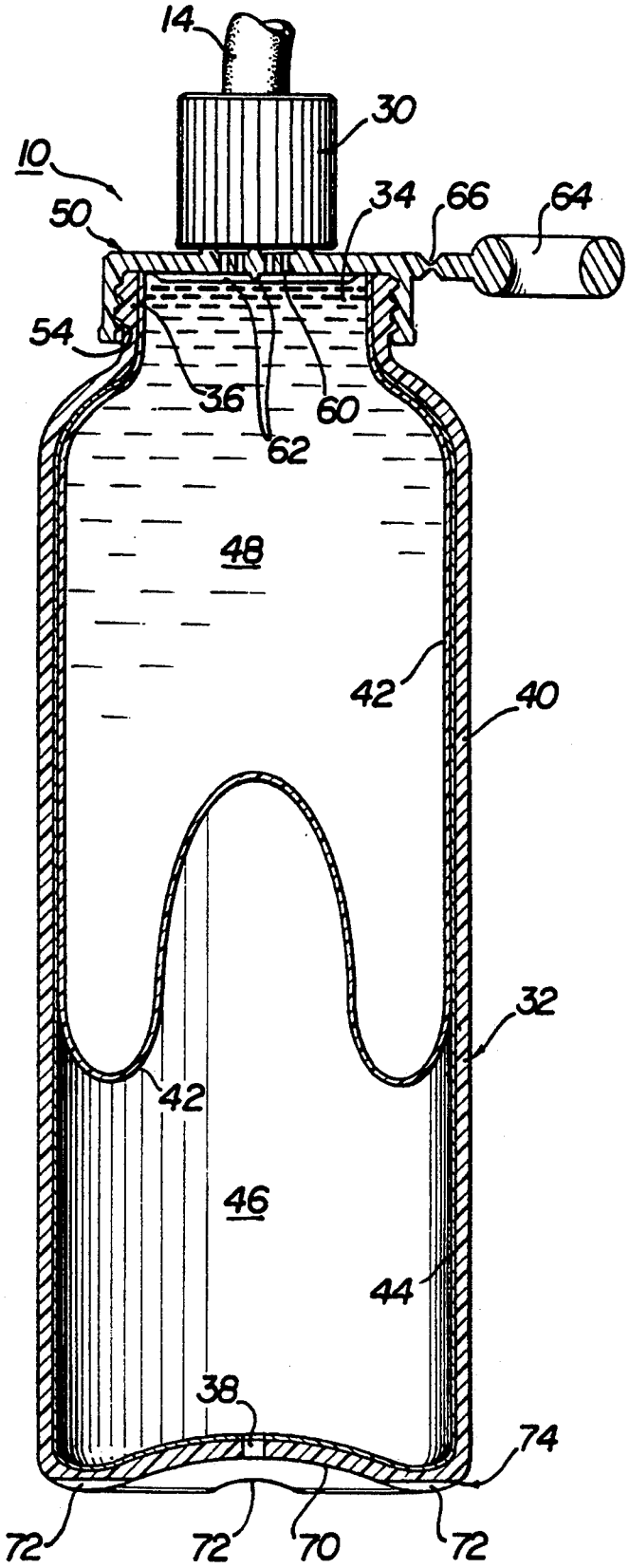
FIG. 6 is a cross-sectional view of the container of FIG. 1 after partial evacuation of the syrup therefrom.
Figure 7:
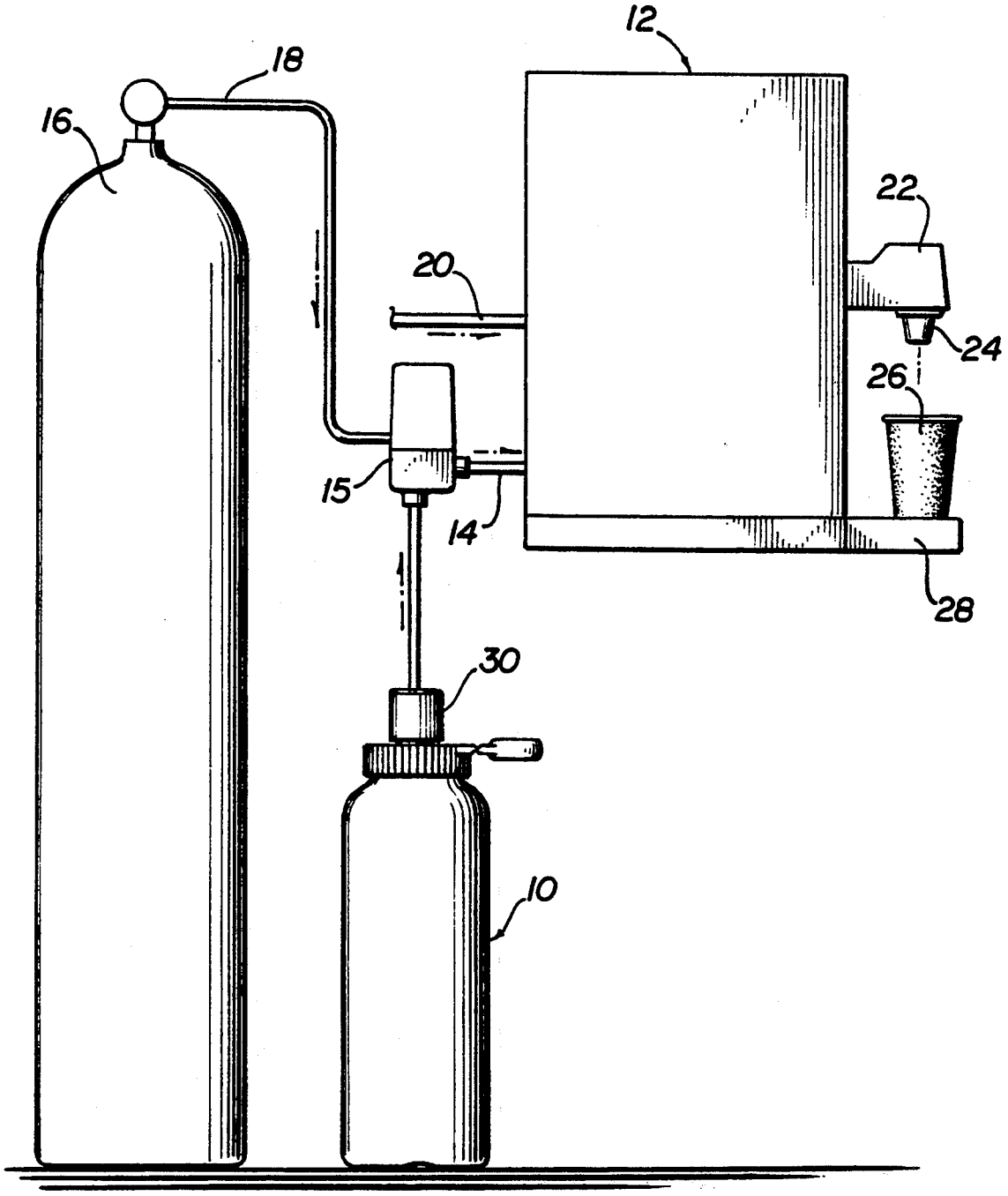
FIG. 7 is a partly schematic, partly diagrammatic view of a syrup container system according to the present invention.
Figure 8:
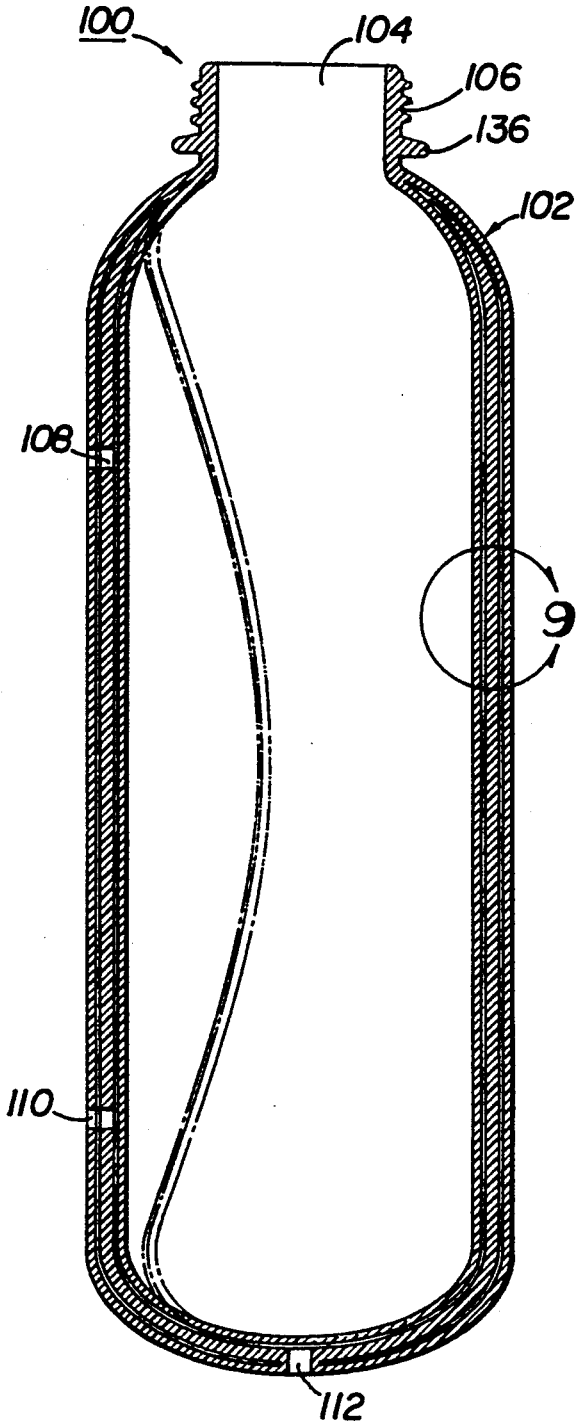
FIG. 8 is a cross-sectional view through a container according to one embodiment of this invention.
Figure 10:
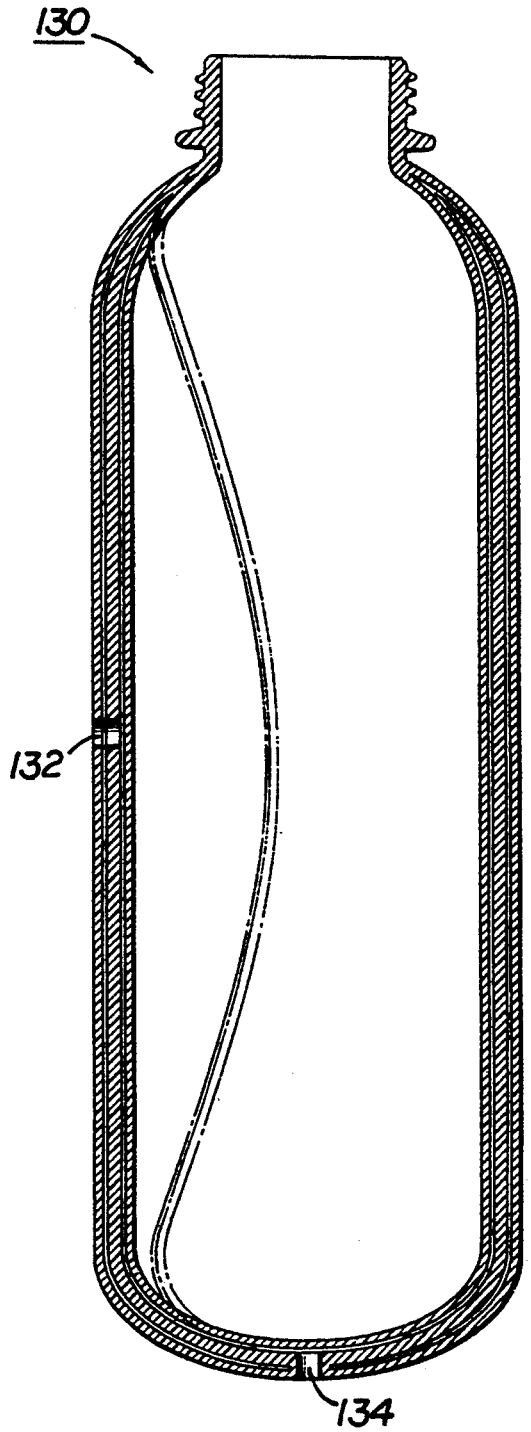
FIG. 10 is a view like FIG. 8 of another container of this invention.
Figure 9:
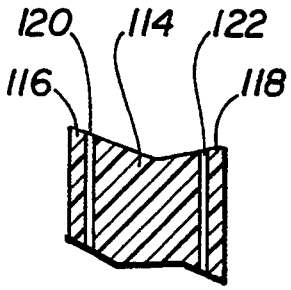
FIG. 9 is an enlarged, partial cross-sectional view through a portion of the wall of the container of FIG. 8.

FIGS. 1–6 show the details of a PET syrup container 10 according to one embodiment of the present invention, FIG. 7 shows the use of the container 10 to supply syrup 48 (see FIG. 2) to a post-mix beverage dispenser 12, FIGS. 8 and 9 show a container according to a preferred embodiment of this invention and FIG. 10 shows another container of this invention.

Referring to FIG. 7, a syrup tube or line 14 connects the container 10 to the dispenser 12 with a syrup pump 15 in the line. The pump 15 is typically operated by gas such as by being connected to a $CO_2$ source 16 through a $CO_2$ line 18. The dispenser 12 is any well-known dispenser and includes an inlet water line 20 connected thereto and includes a plurality of beverage dispensing valves 22 for dispensing a selected beverage from a nozzle 24 into a cup 26 located on a drip tray 28. The syrup line 14 is attached to the container by a known quick-disconnect coupling 30 on the distal end of the line 14.

Referring to FIGS. 1–6, the container 10 includes a wall 32, a container opening 34 (for filling and evacuation) surrounded by a neck 36, an air vent 38 extending partway through the wall, and a closure 50. The wall includes an outer PET layer 40, an inner PET layer 42, and a release agent therebetween such as a layer 44 of EVOH.

The EVOH layer is known for use as an oxygen barrier and in such cases an adhesive layer is used on both sides of the EVOH layer. However, in the container 10, the release layer 44 can be EVOH but the EVOH does not have to have barrier properties, just release properties. In the container 10, no adhesive layer is needed, although it can be used on one side only of the EVOH layer, if desired. In the preferred embodiment, there is no adhesive between the EVOH and the inner PET layer.

Figure 4:
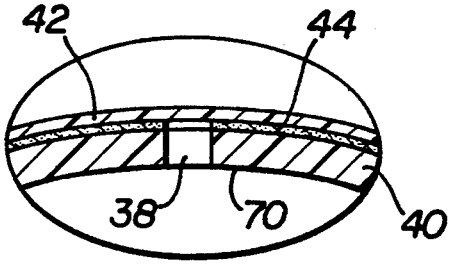
FIG. 4 is an enlarged, partial cross-sectional view through the air vent area of the container of FIG. 1 as it appears after manufacture.

FIG. 4 shows the area around the air vent 38 before evacuation begins. FIG. 5 shows what happens when evacuation begins and the inner layer 42 begins to separate from the outer layer 40 and the EVOH layer 44 producing an air space 46 therebetween.

FIG. 6 shows what happens after partial evacuation. The inner layer 42 simply separates from the outer and EVOH layers and surrounds the remaining syrup, similarly to what happens in the present bag-in-box system of a plastic bag in a paperboard box.

Certain features of the present invention will now be described in detail.

After the container 10 is filled with syrup through the container opening 34, a closure 50 is attached to the neck 36 of the container. Between the time of manufacture and filling, a dust cap (not shown) may be attached to cover the container opening, if desired. The closure includes a cap 52 screw threaded thereon and which is removed when the quick-disconnect coupling 30 is to be attached to the container.

The closure 50 includes screw threads 54 for connecting to the container 10 and screw threads 56 for connecting to the syrup line coupling 30. The screw threads 54 on the closure and/or the screw threads on the neck 36 are preferably ratchet type so that the closure 50 cannot be removed. The screw threads 56 are the same as used now on bag-in-box bag valves for connecting to known syrup couplings.

Figure 1:
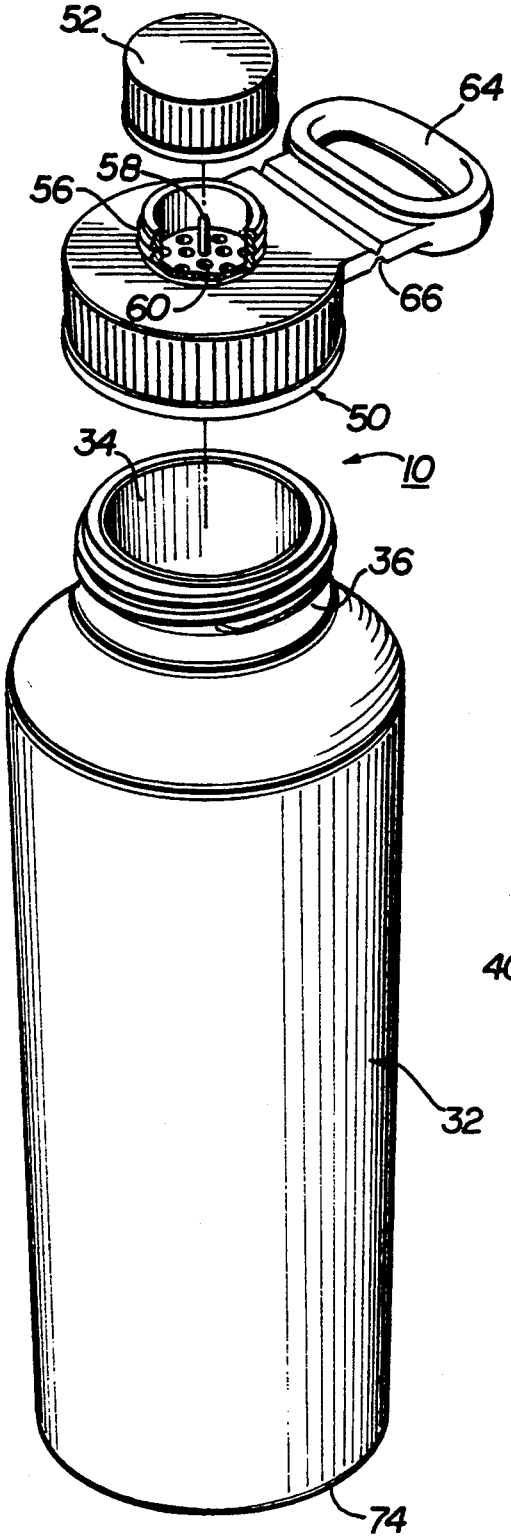
FIG. 1 is a perspective view of a container according to the present invention.
Figure 2:
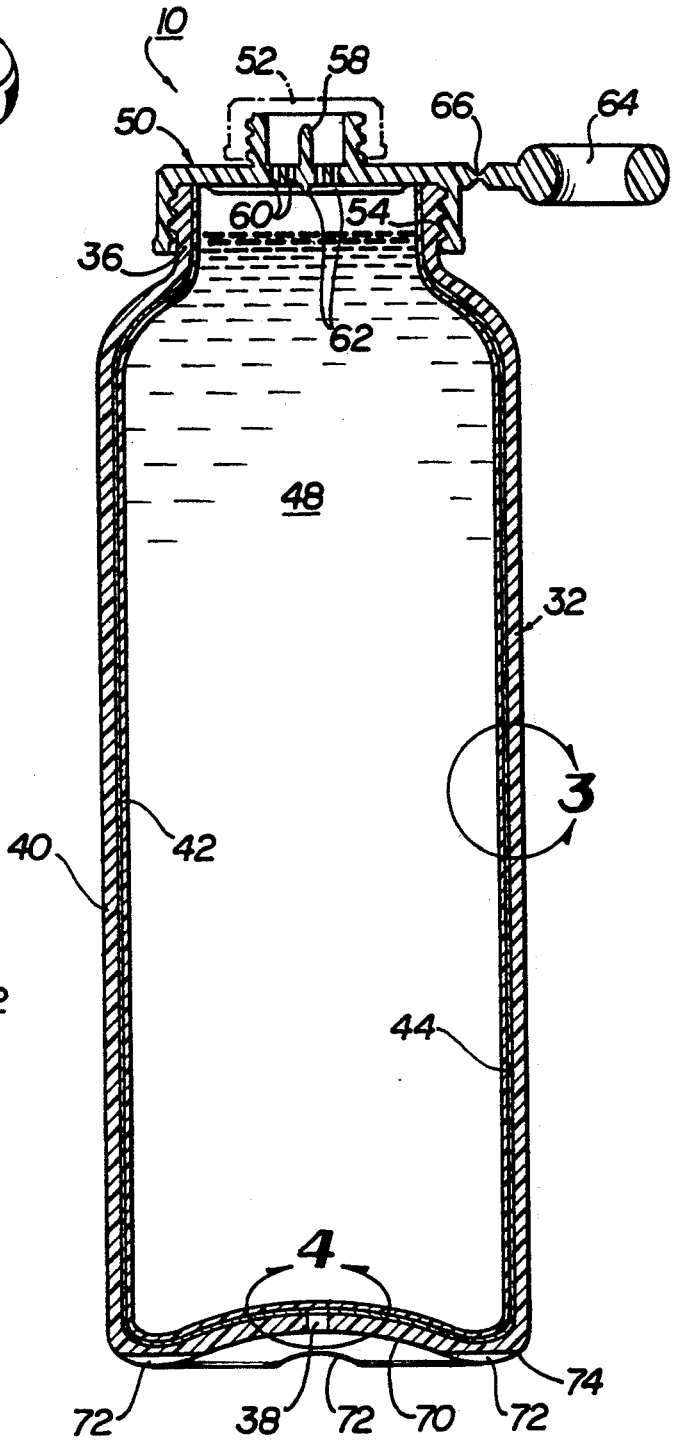
FIG. 2 is a cross-sectional view of a syrup container according to the present invention.

The coupling 30 includes a pin 58 to actuate (open) the valve (not shown) in the coupling 30 in the manner known in the art as the coupling 30 is attached to the closure 50. The closure 50 includes an opening 60 for evacuating the syrup therefrom when the pump is energized. In the preferred embodiment the opening 60 includes a plurality of small holes as shown in FIG. 2. The advantage of the opening 60 being a plurality of holes is that it makes unauthorized refilling difficult. The closure 50 also includes means for preventing the inner layer 42 from collapsing against and closing off the opening 60 prior to all of the syrup being evacuated. In a preferred embodiment this means includes a plurality of ribs 62, although other means such as dip tubes, dip strips and perforated hollow cylinders can be used, as desired. The closure 50 also preferably includes a handle 64 preferably molded or formed as part of the closure. The handle can include a weakened area to act as a hinge 66 for the handle. The ribs 62 can have whatever dimensions are found to work best to achieve the above-stated purpose.

The bottom of the container 10 includes the air vent 38, which is preferably about $\frac{3}{8}$ inch in diameter. Various spacer means can be used to ensure free flow of air into the air vent such as a concave bottom wall 70 surrounded by an annular base 74 with a plurality, preferably four, small radial air slots 72 in the bottom surface of the annular base 74. While this is the preferred arrangement, alternatively the container bottom can be convex and a separate base cup with air openings can be added to the container to keep the air vent 38 from being closed off by contact with the floor.

Figure 3:
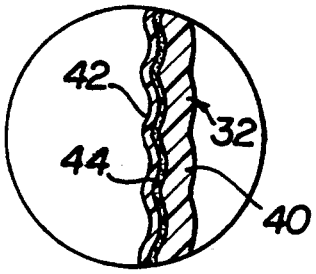
FIG. 3 is an enlarged, partial view of a portion of the container of FIG. 2.

To provide additional strength to the container 10, the wall (at least the elongated portion thereof between the neck and the base) can be provided or formed with strengthening ribs as shown in FIG. 3. Any known form of strengthening ribs can be used. Those shown are very gently curving, with the radial distance from crest to valley being about $\frac{1}{8}$ to $\frac{1}{4}$ inch and the vertical distance from crest to crest being about three to four times the radial distance or about $\frac{1}{2}$ to 1 inch. Vertically extending ribs would be preferred, having a distance of about one inch from crest to crest and a depth of about $\frac{1}{8}$ inch.

The container 10 is preferably cylindrical with a diameter of about 8 inches and a height of about 27 inches to hold five gallons of syrup. The inner and outer walls are preferably of PET and the release layer is preferably EVOH. The outer layer is preferably about 0.02 to 0.025 inch thick. The inner layer is preferably about 0.0015 to 0.0030 inch thick. The EVOH layer is preferably about 0.001 inch thick. The container opening 34 is preferably about 50 mm. in diameter. The wall 32 of the container is thicker at the neck 36 (about $\frac{1}{8}$ inch) similar to the thickness variation in present PET bottles.

The air vent 38 extends through the outer and middle layers but not through the inner layer 42. This air vent hole can be produced in any desired manner, such as by drilling after manufacture or forming during manufacture (forming is preferred).

The three layers are laminated together but the bonding between the inner layer 42 and the EVOH layer 44 is weak such that as syrup is evacuated from the container 10, the inner layer will separate from the EVOH layer as shown in FIGS. 5 and 6. The EVOH layer could separate from the outer layer and stay with the inner layer, but that is not the preferred embodiment. For other release agents, the release agent may not even be a separate layer of material. Preferably, the EVOH layer 44 stops short of the top edge of the neck 36 and the inner and outer layers are bonded together in this area to prevent separation or delamination. The EVOH layer can stop as low as about one-half way up the height of the container, however, preferably it extends all the way up to just short of the neck. Thus, the container wall includes a delaminatable portion where the EVOH layer is located and a non-delaminatable portion where there is no EVOH layer, such as at the neck.

FIGS. 8 and 9 show a container 100 according to another embodiment of this invention. The container 100 is similar to the container 10 of FIGS. 1–7 and can be used in the same way.

The container 100 includes a wall 102, a container opening 104 surrounded by a neck 106 and three air vents 108, 110 and 112 extending partway through the wall. The wall 102 includes a thick, main central PET layer 114 and thin inner and outer PET layers 116 and 118, respectively, with thin inner and outer layers 120 and 122, respectively, of release agent (preferably EVOH) between the thin layers and the main layer. The container 100 preferably has vertical ribs for strength.

The differences between the container 100 and the container 10 are that the container 100 has two additional air vents 108 and 110 (preferably about ¼ inch in diameter) and that there is an additional PET layer 118 on the outside of the main PET layer 114 with an additional layer 122 of EVOH therebetween as shown in FIG. 9. The inner and outer wall layers 116 and 118 preferably have a thickness of about 0.0015 to 0.0030 inch, the main layer 114 is preferably about 0.02 to 0.025 inch thick. The EVOH is preferably about 0.001 inch thick.

When the container 10 or 100 is placed horizontally in use, the air vent 38 or 112 is sufficient. However, when placed vertically, the weight of the syrup can keep the air vent 38 closed and the entire container 10 could collapse as the syrup is withdrawn. The purpose for the additional air vents 108 and 110 is to prevent such collapse and to ensure that the inner layer 116 collapses and releases from the remainder of the wall of the container. Preferably, one air vent 108 is toward the top and one air vent 110 is toward the bottom of the container 100. The air vents 108 and 110 are preferably axially spaced-apart and approximately in-line circumferentially.

In the portion of the container wall surrounding the opening 104, the wall is all PET, with no EVOH, as shown in FIG. 8.

The container 100 preferably has vertical (axially extending) ribs for strength, although it can also have circumferential ribs in addition to the vertical ribs.

FIG. 10 shows a container 130 like container 100 except that it has only one side air vent 132 plus a bottom air vent 134.

The air vents can be formed in any desired fashion, including drilling, and terminate at the inner PET layer 116, that is, they terminate directly at the inner layer or in or at the inner EVOH layer adjacent the inner PET layer. The air vents extend through the rest of the layers, including the other PET layer or layers and any other release layer(s). The air vents preferably extend through the EVOH layer adjacent the inner PET layer, although this is not essential.

Figure 11:
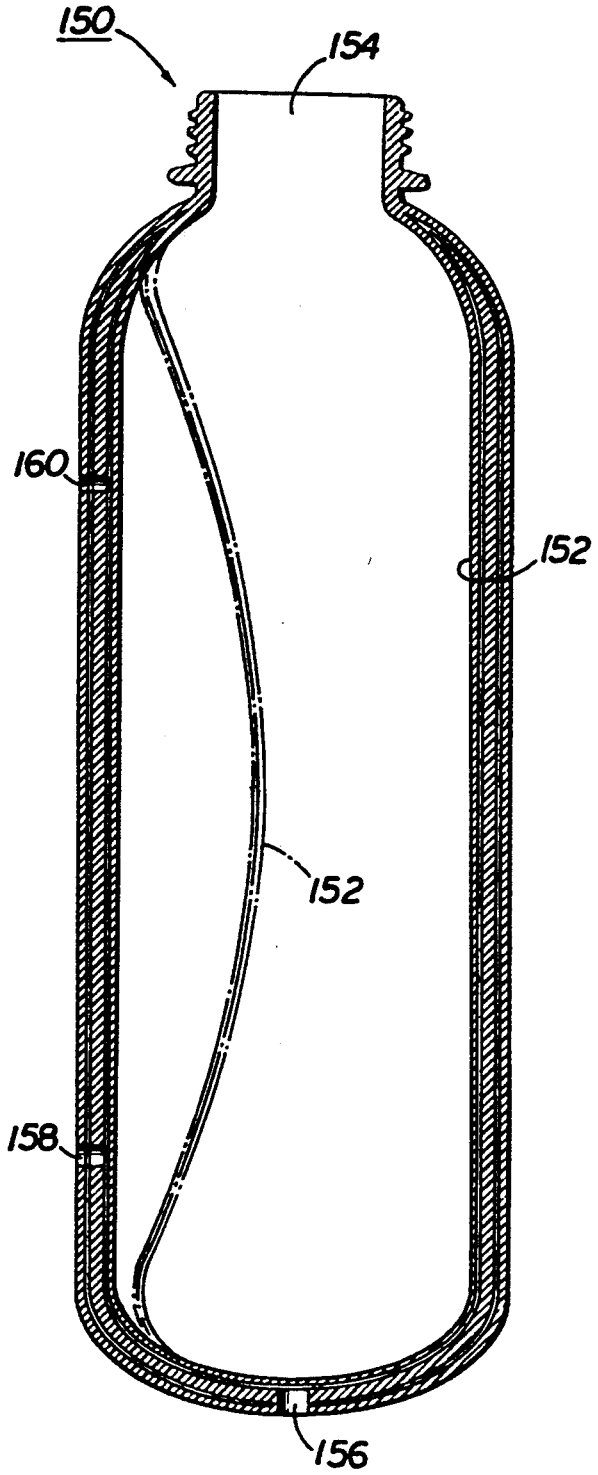
FIG. 11 is a cross-sectional view through a container according to a preferred embodiment of this invention.

FIG. 11 shows a container 150 according to another embodiment of the present invention. The container 150 is similar to container 100 of FIGS. 8–10 and to container 10 of FIGS. 1–7 and can be used in the same way. Container 150 differs from container 100 in that container 150 includes one or preferably both of the following features. The first feature is that the inner layer 152 is relatively thicker adjacent the top or opening 154 and is thinner towards the bottom of the container. The difference in thickness along the height of the inner layer is preferably about one rail. The second feature is that there are more and/or larger air vents toward the bottom of the container 150. For example, FIG. 11 shows an air vent 156 at the bottom, a first sidewall air vent 158 a distance up from the bottom and a second sidewall air vent 160 toward the top. Air vent 156 is the largest in open area, then air vent 158 and finally air vent 160 is the smallest in open area.

The purpose of both of these features is to prevent the inner layer 152 from collapsing prematurely at the top of the container and possibly closing off a portion of the bag toward the bottom. The different size air vents will help restrict air flow to the upper area that could otherwise result in premature collapse of the upper portion of the inner layer. The greater relative wall thickness at the top also helps prevent such premature collapse.

Figure 12:
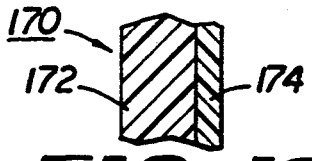
FIG. 12 is a partial, cross-sectional view of a container according to another embodiment of this invention.

While the container 150 of FIG. 11 is shown as being similar to the container 100 of FIGS. 8–10 and to container 10 of FIGS. 1–7, it can alternatively be a multilayer container 170 as partially shown in FIG. 12 having a main layer 172 and an inner layer 174, with no release agent or layer therebetween and wherein the two layers are blow molded in separate operations. That is, this feature of the invention is not limited to use with a container made by blow molding all at one time from a multilayer preform using a release or agent between the main and inner layer.

Figure 13:
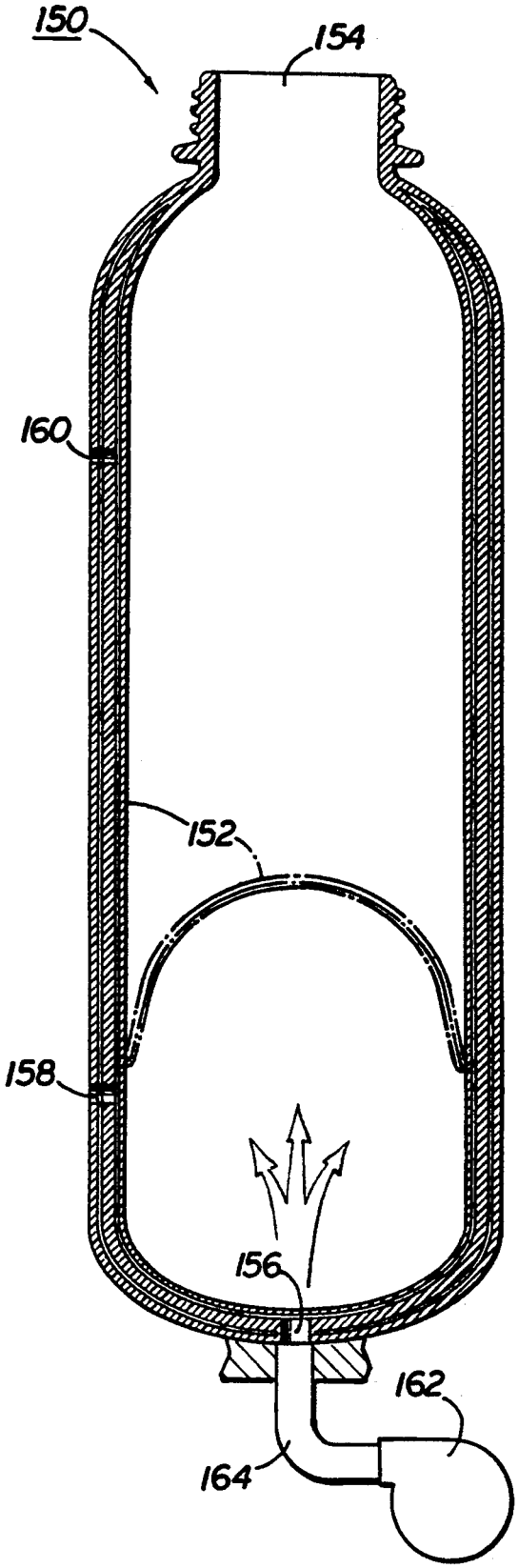
FIG. 13 is a cross-sectional view as in FIG. 11 showing the predelamination feature of this invention.

FIG. 13 shows another aspect of the present invention, namely that of at least a partial predelamination of the inner layer, preferably during manufacture, to make collapse of the inner layer easier during actual use. After manufacture, a gas pressure differential is applied across the inner layer at the location of preferably the bottom air vent 156. This pressure differential can be by applying suction inside or pressure outside. Preferably, air under pressure is forced by a pump 162 through a line 164 through one or more of the air vents, preferably the bottom one as shown in FIG. 13 of a sufficiently high pressure to at least partially predelaminate the inner layer as shown diagrammatically in FIG. 13. The inner layer is then preferably returned to its original fully expanded position. The reexpansion can be by suction through the same air vent or preferably by gas under pressure being fed through the opening 154. Alternatively, the inner layer can be left partially collapsed and the liquid will return it to its original expanded position during filling.

The containers are preferably manufactured by blow molding from laminated preforms using any well-known stretch and blow process from a coextruded preform, as described, for example, in U.S. Pat. Nos. 4,032,341 and 4,609,516.

The containers can be used in any position, but vertical is preferred. No container valve is required, unless the coupling is to be connected while the container is horizontal. The containers can be used with the same exact equipment presently used with the existing bag-in-box syrup container.

While the preferred embodiment of this invention has been described above in detail, it is to be understood that variations and modifications can be made therein without departing from the spirit and scope of the present invention. For example, while various numbers of PET layers have been shown, additional layers can be used, if desired. While various air vents have been shown, others can be used and in different locations, if desired. The wall layers 40, 42, 114, 116 and 118 are preferably all made of PET and the closing of polyethylene for ease of recycling. While a particular handle has been shown, others can be used, such as one separate from the closure to connect to the bottle under the flange 136. The containers are preferably cylindrical although other shapes such as cubical (with rounded corners) or spherical can be used. While the preferred container size is five gallons, the container can be made in any desired size, such as one gallon, two gallon, etc. The preferred application is for use with syrup in post-mix beverage dispensing; however, other liquids and other applications can be used. The container is preferably disposable, although it can be reused by blowing the inner layer back to its original position and shape, cleaning and refilling. Other plastics than PET and other release layers or agents than EVOH can be used. For example, depending on the use of the container, other plastic materials such as certain nylons, copolyesters, polypropylene (PP), PP/PET blends, polyacrylonitrile, polycarbonate and the like can be used. When using a plurality of air vents, it is preferred to have one in the bottom wall of the container, although this is not essential. When using a plurality of air vents, it is not necessary to have the spacer means.

What is claimed is:

1. A method for making a multilayer liquid container comprising:

(a) providing a blow molded, multi-layer liquid container including a wall, a container opening at a top end of said container opposite a bottom end thereof for filling and evacuating said container surrounded by a container neck, and a plurality of air vents including at least one bottom air vent in said bottom of said container, said air vents extending partway through said wall; said wall including a main plastic layer and a separate, delaminatable inner plastic layer such that said inner layer can separate from said main layer when syrup is evacuated by suction from said container and air flows in through said plurality of air vents; said air vents extending completely through said main layer and terminating at said inner layer and said plurality of air vents being permanently open to atmosphere, such that air can flow in through said air vents and in between said inner and main layers as syrup is withdrawn by suction from said container; and (b) after said main and inner layers have been blow molded, at least partially predelaminating said inner layer from said main layer starting at said bottom end of said container, said predelaminating step comprising applying a gas pressure differential across said inner layer at said bottom air vent.

2. The method as recited in claim 1 wherein said predelaminating step comprises applying air under pressure to said bottom air vent at a sufficiently high value to cause said inner layer to delaminate from said main layer.

3. The method as recited in claim 2 including the step of reexpanding said inner layer to its original position after terminating said predelamination step.

4. An article comprising:

(a) a multi-layer liquid container including a wall, a container opening at a top end of said container for filling and evacuating said container surrounded by a container neck, and a plurality of air vents extending partway through said wall;

(b) said wall including a main plastic layer and a separate, delaminatable inner plastic layer such that said inner layer can separate from said main layer when liquid is evacuated by suction from said container and air flows in through said air vents;

(c) said air vents extending completely through said main layer and terminating at said inner layer and said air vents being permanently open to atmosphere, such that air can flow through said air vents and in between said inner and main layers as liquid is withdrawn by suction from said container;

(d) said container having a bottom end opposite said top end and said inner layer having a greater wall thickness adjacent said opening and tapering to a lesser wall thickness adjacent said bottom end;

(e) said plurality of air vents including at least one bottom air vent in said bottom end and a first and second sidewall axially spaced-apart sidewall air vents, said first air vent being closer to said bottom end than to said top end and said second sidewall air vent being between said first air vent and said opening; and (f) said bottom air vent having an open area larger than that of said first sidewall air vent and said first air vent having an open area larger than that of said second sidewall air vent.

5. The article as recited in claim 4 wherein the difference in thickness of said inner layer along its length is about one mil.

6. The article as recited in claim 4 wherein said layers are both blow molded of PET.

7. The article as recited in claim 6 including a release agent located between said layers.

* * * * *